United States Patent [19]

Feichtinger

[11] Patent Number: 4,530,314

[45] Date of Patent: Jul. 23, 1985

[54] WATER-COOLED TWO-CYLINDER TWO-STROKE INTERNAL COMBUSTION ENGINE

[75] Inventor: Gerhard Feichtinger, Graz, Austria

[73] Assignee: A V L Gesellschaft Für Verbrennungskraftmaschinen Und Messtechnik M.B.H., Graz, Austria

[21] Appl. No.: 590,568

[22] Filed: Mar. 16, 1984

[30] Foreign Application Priority Data

Mar. 29, 1983 [AT] Austria ..... 1115/83

[51] Int. Cl.[3] ..... F02F 1/10

[52] U.S. Cl. ..... 123/41.74; 123/41.84; 123/65 PE

[58] Field of Search ..... 123/74 R, 193 C, 193 CH, 123/41.72, 41.84, 65 PE, 41.74, 41.81

[56] References Cited

U.S. PATENT DOCUMENTS

| | | | |
|---|---|---|---|
| 877,834 | 1/1908 | Daniel | 123/41.72 |
| 2,020,461 | 11/1935 | Dennison et al. | 123/41.72 |
| 2,560,700 | 7/1951 | Pervier | 123/41.72 |

FOREIGN PATENT DOCUMENTS

| | | | |
|---|---|---|---|
| 2109189 | 9/1972 | Fed. Rep. of Germany | 123/41.84 |
| 2433813 | 6/1975 | Fed. Rep. of Germany | 123/41.72 |

*Primary Examiner*—Charles J. Myhre
*Assistant Examiner*—R. S. Bailey
*Attorney, Agent, or Firm*—Watson, Cole Grindle & Watson

[57] ABSTRACT

A two-cylinder two-stroke internal combustion engine is provided with inserted cylinder liners carrying separate thin-walled cooling jackets. In the area of the intake and exhaust ports the walls of the liners are thickened in order to improve the directing of the inflowing charge and to facilitate a leak-proof attachment of the cooling jackets.

The areas of the two cylinder liners facing each other are not thickened nor do they have any ports; they are only provided with a collar continuing the upper edge of the thickened portion and serving for the leak-proof attachment of the cooling jacket, such that the space between the cylinders lying below this collar may be utilized for the exchange of fresh charge between the two longitudinal sides of the engine, without the need for an increase of the distance between the cylinders.

1 Claim, 5 Drawing Figures

WATER-COOLED TWO-CYLINDER TWO-STROKE INTERNAL COMBUSTION ENGINE

BACKGROUND OF THE INVENTION

This invention relates to a two-stroke internal combustion engine comprising cylinder liners which are inserted into the engine housing and each are provided with a chamber containing the cooling water, and with piston-controlled intake and exhaust ports positioned in a thickened sector of their walls. Each cooling water chamber being bounded on the outside by a thin-walled cooling jacket which in the area of the thickened wall of the cylinder liner is attached to the latter in a leak-proof manner, and which overlaps the exhaust ports and carries ports of its own coinciding with the exhaust ports of the cylinder liner. The thickened wall of each of the cylinder liners being provided with open channels around the exhaust ports such that this area is connected to the cooling water chamber as the open channels are covered by the cooling jacket.

DESCRIPTION OF THE PRIOR ART

Combustion engines of this type are known, for instance from German Patent Specification No. 464 699, the disadvantage being that the cooling water chamber formed by the downward extension of the cooling jacket requires a relatively large amount of space in the area between two adjacent cylinders, which will make it difficult to provide connecting spaces between the individual cylinders for the exchange of fresh air to be fed into the intake ports located on either side, unless the distances between the cylinders—and thus the total dimensions of the engine—are increased.

SUMMARY OF THE INVENTION

It is an object of the present invention to avoid the drawbacks of the above type of combustion engine and, above all, to reduce the distance between the cylinder axes in the engine housing, without incurring functional disadvantages vis-à-vis the known designs.

In a two-cylinder engine of the abovementioned type—with the intake ports being located on either side of the exhaust ports on the front ends of the combustion engine, and the intake ports being directed towards the side walls of the engine, and those areas of the cylinders not carrying any ports being located next to each other in the center of the engine—the mentioned aim of the invention is achieved here by designing the cooling jackets such that in the area of the intake ports, or in the portless section between the two cylinders, each jacket extends downwards only as far as the upper edge of the thickened wall portion, i.e., that one closest to the cylinder head, or to a collar continuing this upper edge in the portless section, where it is tightly sealed. The seal may be established by welding, brazing, glueing or pressing, for instance. The outer wall of the cylinder liner is formed by a thin jacket of sheet metal which will allow total dimensions of the combustion engine in the direction of the crankshaft axis to be kept correspondingly small. Since the chamber carrying the cooling water is directly adjacent to the exhaust ports sufficient cooling may be ensured for the cylinder liner in the area of the exhaust ports; the sheet metal jacket can be attached to the cylinder liner in the area of the exhaust ports without difficulty. In conjunction with the open channels around the exhaust ports the sheet metal jacket serves to form channels which are sealed against the exhaust ports such that a space below the exhaust ports may also be connected to the cooling water chamber. The sheet metal jacket does not cover the area of the intake ports, which will permit the outward openings of the intake ports (i.e. the one directed towards the periphery of the thickened wall portion) to be properly rounded (lower flow resistance), and which will help to save weight in the portless section of the cylinder liner, i.e., opposite of the outlet ports, where the wall of the cylinder liner need not be thickened. Since the outlet ports are positioned on the front ends of the two-cylinder engine sufficient space is provided between the cylinder liners for the flow of air to the respective other side of the engine, without having to increase the distance between the cylinders.

DESCRIPTION OF THE DRAWING

The following is a more detailed description of the invention as illustrated by the enclosed drawing, in which.

Figure 1:
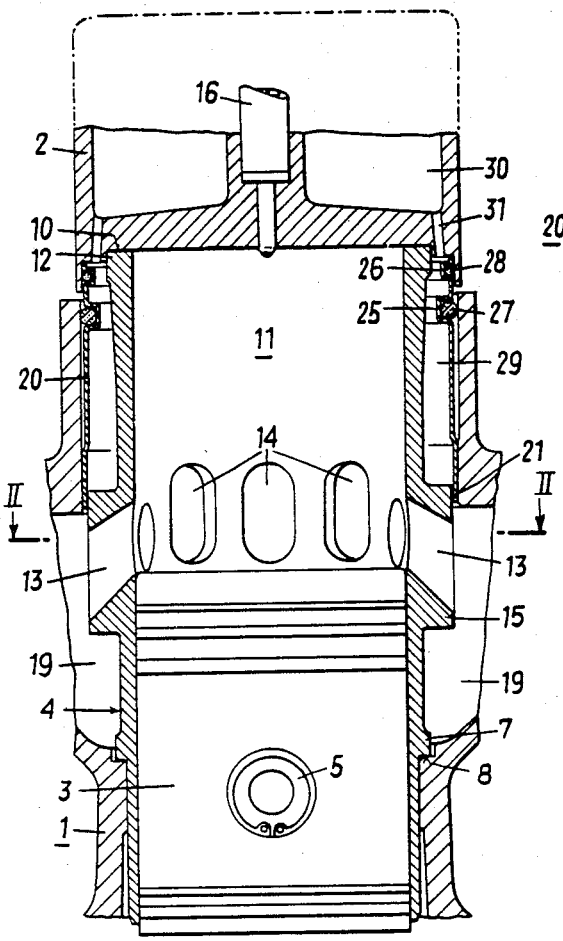
FIG. 1 shows a section of that part of the combustion engine most relevant to the invention, along line I—I in FIG. 2.

The engine housing of the internal combustion engine which may be integrated with the crankshaft housing, is denoted 1, the cylinder head 2, the piston 3, and the cylinder liner is given the number 4. At piston pin 5 of each piston 3 a connecting rod 6 is attached, establishing the connection to the crankshaft (which is not shown here). The cylinder liners 4 are inserted into the engine housing 1, where they are resting against the liner seat 8 of the engine housing 1 by means of a ring-shaped bulge 7. The cylinder heads 2 are fastened to the cylinder liners 4 by means of cylinder-head screws passing through the cylinder head in bores 9, such that the cylinder liners 4 are held in place in the engine housing 1. A ring-shaped cylinder head gasket 10 of variable thickness for adjusting the desired distance between the piston 3 and the cylinder head 2, is used for sealing the combustion chamber 11. The cylinder head 2 is centered on the cylinder liner 4 by the outer edge of the sealing flange 12 of the liner. The center nozzle in the cylinder head 2 has the number 16.

Figure 3:
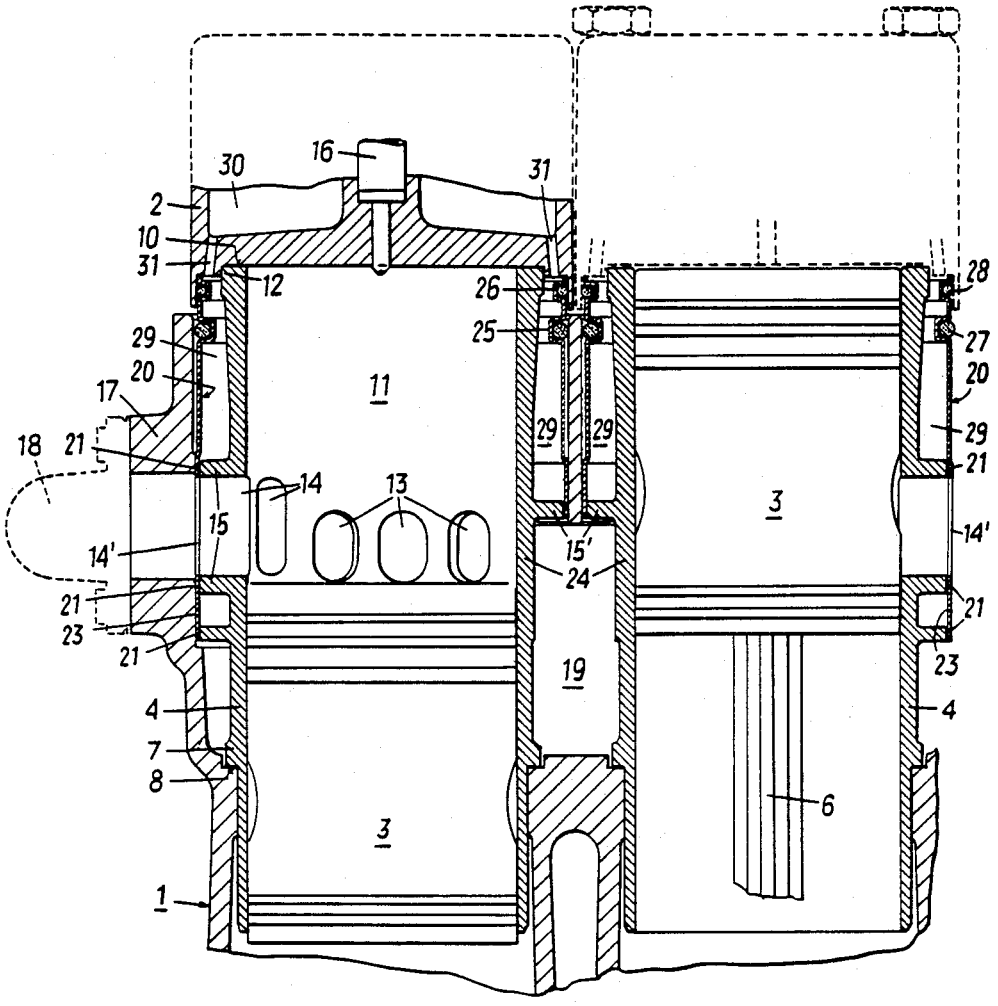
FIG. 3 shows a section along line III—III in FIG. 2.

Each cylinder liner 4 is provided with intake ports 13 and outlet ports 14 which are controlled by the piston 3 and are located in a thickened part 15 of the cylinder liner 4. The intake ports 13 are located on either side of the outlet ports 14, resulting in a reverse scavenging system. As is shown in FIG. 3, the outlet ports 14 open into a common exhaust manifold 18 via a flange 17. The intake ports 13 are supplied with fresh charge from charging chambers 19.

Figure 4:
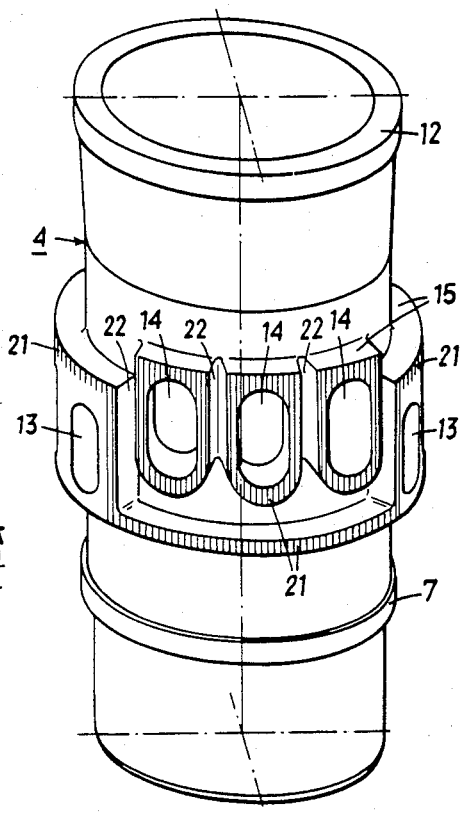
FIG. 4 is a perspective view of the cylinder liner.

The cylinder liner 4 is surrounded by a sheet metal jacket 20 which is tightly sealed against the cylinder liner 4 in the area of the thickened wall 15, and of the collar 15' in that sector 24 where the wall is not thickened; the seal is effected by welding, brazing, glueing or pressing, along the areas of contact between the sheet metal jacket and the periphery of the thickened wall 15 or the collar 15'. The contact areas 21 are represented by the hatched areas in FIG. 4. In the area of the outlet ports 14 open water channels 22 are provided which may be made by casting or milling. The cylindrical sheet metal jacket 20 has an apron 23 overlapping the outlet ports 14. Correspondingly, the apron 23 is provided with ports 14' whose size and position coincide with those of the outlet ports 14. The sheet metal jacket 20 does not cover the intake ports 13 in order to permit the outward openings of the intake ports to be properly rounded (lower flow resistance), and to save weight in the sector 24 of the cylinder liner 4 where no ports are provided, i.e., opposite the outlet ports 14, where the wall of the cylinder liner 4 is not thickened. Since the outlet ports are positioned on the front ends of the two-cylinder engine sufficient space is provided between the cylinder liners for the flow of air between the longitudinal sides of the engine—where usually collecting chambers for the intake air are provided in a manner not shown here and connected to an inlet pipe at least at one longitudinal side of the engine—without the need for an increase of the distance between the cylinders.

Figure 5:
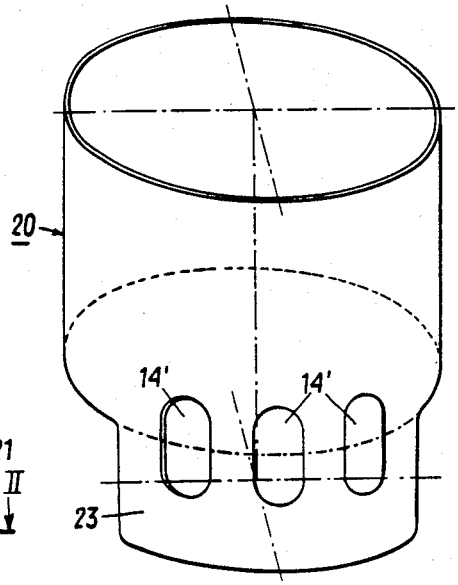
FIG. 5 is a view of the sheet metal jacket, presented as in FIG. 4.
Figure 2:
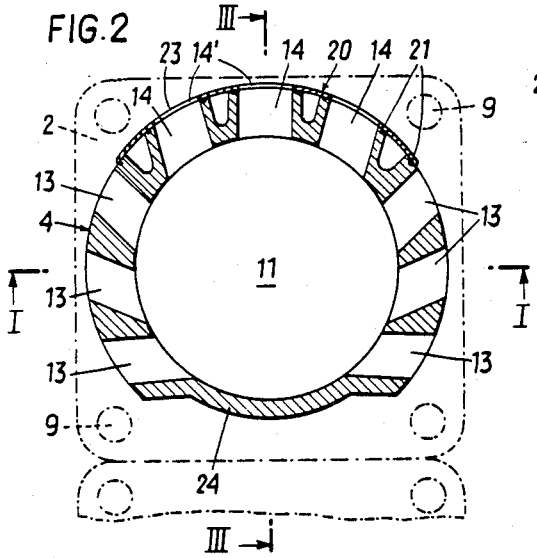
FIG. 2 shows a section along line II—II in FIG. 3.

The rim of the sheet metal jacket 20 adjacent to the cylinder head 2 is provided with two rolled-in annular groves 25 and 26, carrying the O-rings 27 and 28. In the simplified presentation in FIG. 5 these two grooves have been omitted. The lower O-ring 27 will seal the chambers for the intake and exhaust air against the engine housing 1, and will also prevent splash water and dirt from entering the crankshaft housing from above. The upper O-ring 28 will seal the water chamber 29 between cylinder liner 4 and sheet metal jacket 20 against the cylinder head 2. The water chamber 30 of the cylinder head 2 is connected to chamber 29 of the cylinder liner by small bores 31.

I claim:

1. A water-cooled, two-cylinder, two-stroke internal combustion engine comprising, an engine housing having two cylinder liners defining cooling water chambers, said liners each having a thickened wall portion containing piston-controlled intake and exhaust ports, said intake ports being located on either side of said exhaust ports at front ends of the engine and being directed toward longitudinal side walls of the engine, said liners each having an unthickened wall portion devoid of any intake and exhaust ports, said unthickened wall portion of each said liner being adjacent one another at the center of the engine, the engine further comprising a thin-walled cooling jacket delimiting each of said cooling water chambers, each said jacket being attached in a leak-proof manner to each said thickened wall portion, each said jacket overlapping said exhaust ports of each said liner and having ports coinciding with said exhaust ports, said thickened wall portion of each said liner being further provided with open channels arounds said exhaust ports thereof and being covered by each said jacket and being in open communication with each said cooling water chamber, and each of said cooling jackets, in the vicinity of said intake ports and at each said unthickened wall portion between said two cylinders, extending downwardly only to the upper edge of each said thickened wall portion and to a collar at the upper edge of each said unthickened wall portion at which each said cooling jacket is tightly sealed.

* * * * *

UNITED STATES PATENT AND TRADEMARK OFFICE

CERTIFICATE OF CORRECTION

PATENT NO. : 4,530,314

DATED : July 23, 1985

INVENTOR(S) : Gerhard Feichtinger

It is certified that error appears in the above-identified patent and that said Letters Patent is hereby corrected as shown below:

In the title page, correct the name of the Assignee to read --A V L GESSELLSCHAFT FÜR VERBRENNUNGSKRAFTMASCHINEN UND MESSTECHNIK M.B.H. Prof.Dr.Dr.h.c. Hans List, Graz, Austria--

Signed and Sealed this

*Twenty-fifth* Day of *March 1986*

[SEAL]

*Attest:*

DONALD J. QUIGG

*Attesting Officer*

*Commissioner of Patents and Trademarks*